United States Patent [19]

Smith et al.

[11] 4,252,639

[45] Feb. 24, 1981

[54] COAL BENEFICIATION PROCESSES

[75] Inventors: Clay D. Smith; Douglas V. Keller, Jr., both of Lafayette, N.Y.

[73] Assignee: Otisca Industries, Ltd., Syracuse, N.Y.

[21] Appl. No.: 91,129

[22] Filed: Nov. 5, 1979

Related U.S. Application Data

[63] Continuation-in-part of Ser. No. 561,168, Mar. 24, 1975, Pat. No. 4,173,530.

[51] Int. Cl.[3] ..... B03B 1/04; B03B 5/44

[52] U.S. Cl. ..... 209/5; 209/9; 209/172

[58] Field of Search ..... 209/5, 9, 172, 207, 209/3, 4

[56] References Cited

U.S. PATENT DOCUMENTS

| | | | |
|---|---|---|---|
| 2,109,234 | 2/1938 | Kennan | 209/172 X |
| 2,165,607 | 7/1939 | Blow | 209/172 |
| 2,686,592 | 8/1954 | Miller | 209/172 X |
| 3,098,035 | 7/1963 | Aplan | 209/5 |
| 3,348,675 | 10/1967 | Tveter | 209/172 X |
| 3,349,909 | 10/1967 | Studer | 209/172 X |

*Primary Examiner*—Ralph J. Hill

*Attorney, Agent, or Firm*—Le Blanc, Nolan, Shur & Nies

[57] ABSTRACT

A method of beneficiating coal in which the coal is conditioned by agitating it in the presence of a dense halogenated hydrocarbon and a surface active agent to effect a transfer of surface water from the coal to mineral matter associated therewith and an agglomeration of the mineral matter and to envelop the coal in a film of the surface active agent. The conditioned coal is then introduced into a halogenated hydrocarbon bath having a specific gravity intermediate those of the coal and the mineral matter. The agglomerated mineral matter sinks to the bottom of the bath in the region of feedstock introduction, and the coal disperses in and migrates to the top of the bath.

14 Claims, 1 Drawing Figure

COAL BENEFICIATION PROCESSES

Figure 1:
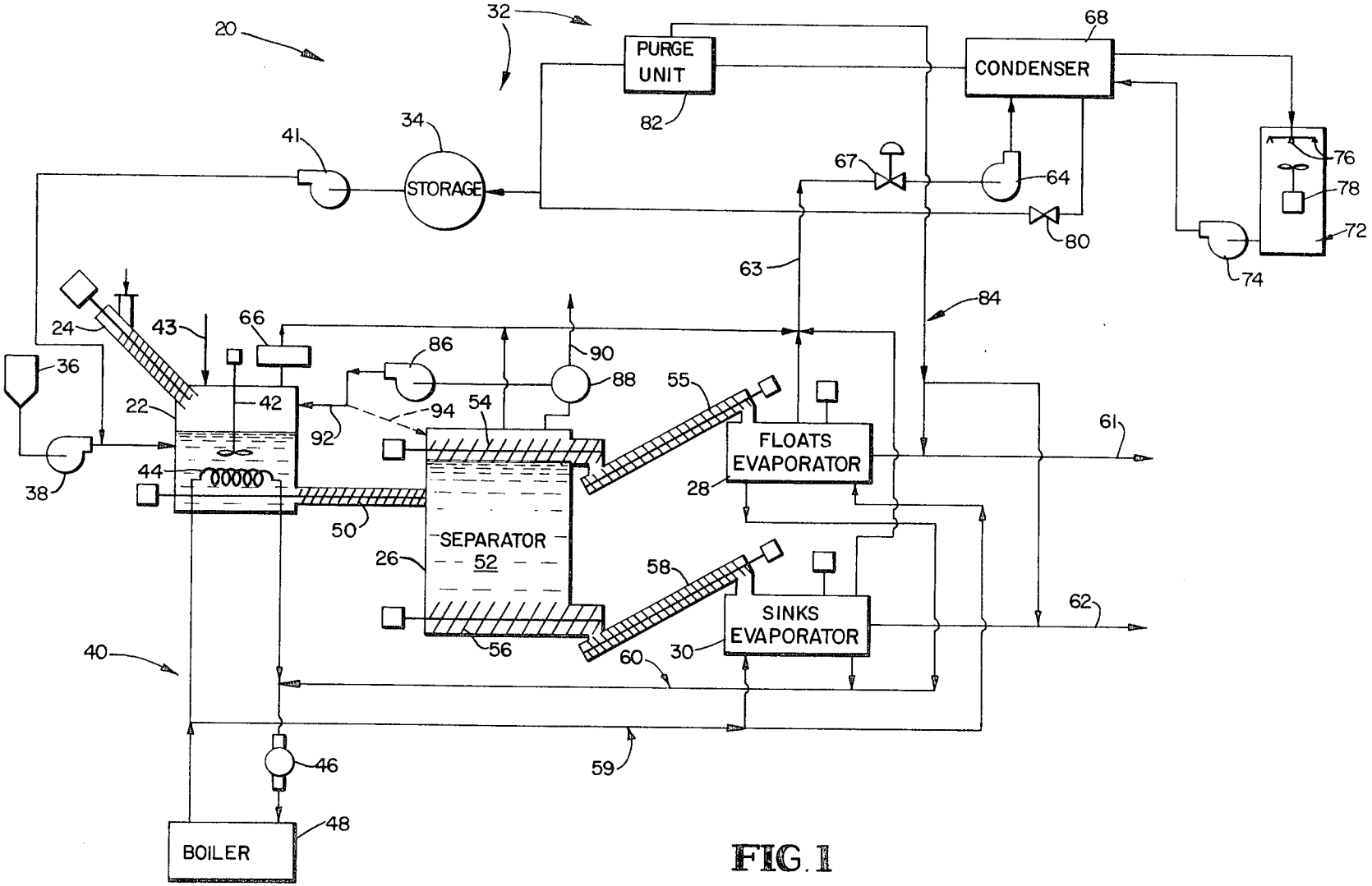

This application is a continuation-in-part of application Ser. No. 561,168, filed Mar. 24, 1975 (now U.S. Pat. No. 4,173,530 issued Nov. 6, 1979).

The present invention relates to the beneficiation of coal and, more particularly, to novel, improved coal beneficiation processes in which the coal is first conditioned with a halogenated hydrocarbon and a surface active agent and in which the coal is subsequently recovered by differential density separation also in a halogenated hydrocarbon.

Certain terms used herein are defined as follows:

Raw coal—a composite of product coal and mineral matter which constitutes the feedstock for a process designed to remove at least part of the mineral matter therefrom. The raw coal may be as mined with or without having been subjected to preliminary preparation; or it may be the black water from a hydrobeneficiation plant or the culm from a sludge pond, etc.

Product (or "clean") coal—the carbonaceous coal phase generated in and recovered from a specified cleaning process and containing a lower percentage of impurities than the raw coal from which it is produced.

Mineral matter (or "refuse" or "gangue")—terms used herein for the sake of convenience to collectively identify the inorganic substances present in raw coal including rock, slate, shale, sulfur compounds, and water.

Ash—the non-combustibles present in raw and product coal. The ash may differ in content and composition from the mineral matter in the coal but is related thereto.

Floats—the lighter of two phases of solids generated by a density differential separation and composed primarily of product coal.

Sinks—the more dense of the two phases generated by a density differential separation and composed primarily of refuse.

The use of heavy halogenated hydrocarbons in the beneficiation of coal has heretofore been proposed in U.S. Pat. Nos. 994,950, issued June 13, 1911, to DuPont; 2,150,899, issued Mar. 21, 1939, to Alexander et al; 2,150,917, issued Mar. 21, 1939, to Foulke et al; 2,151,578, issued Mar. 21, 1939, to Alexander et al; 2,208,758, issued July 23, 1940, to Foulke et al; 2,842,319, issued July 8, 1956, to Reerink et al; 3,062,252, issued Mar. 20, 1962, to Muschenborn et al; 3,098,035, issued July 16, 1963, to Aplan; and 3,348,675, issued Oct. 24, 1967, to Tveter; in Roe et al, Application of Heavy-Liquid Processes to Mineral Beneficiation, SME TRANSACTIONS, June, 1963, pp. 141-146; and in Patching, Developments in Heavy-Liquid Systems for Mineral Processing, MINE & QUARRY ENGINEERING, April, 1964, pp. 158-166.

In those beneficiation processes described in the just identified prior art, advantage is taken of the differences in specific gravity between product coal (typically 1.25 to 1.55) and the impurities associated therewith in raw coal (typically 1.8 to 6.0) to separate the coal from the impurities.

The raw coal is introduced into a body of a parting liquid having a specific gravity intermediate that of the product coal and the impurities. By virtue of Archimedes' principle, the product coal rises to the top of the parting liquid; and the mineral matter or gangue sinks to the bottom. The two layers or phases of material, respectively termed "floats" and "sinks," are recovered separately from the body of parting liquid.

In one broad aspect our novel process differs from the conventional heavy liquid gravity separation processes described in the prior art in that we condition the raw coal with a halogenated hydrocarbon and a surface active agent by agitating a slurry of these constituents before attempting the subsequent step in which the product coal is recovered from the associated refuse by density differential separation.

Conditioning of the raw coal in the manner just described not only increases the efficiency of the subsequent product coal recovery step; it completely changes the character of that step.

Specifically, in the conventional heavy liquid gravity separation of coal, the parting liquid bath is occupied by dispersions of both product coal particles and particles of refuse ranging in size down to ultrafine. The product coal and mineral matter particles move through the bath in opposite directions and at size dependent velocities in accord with well-known physical laws.

In contrast, in feedstock conditioned in accord with the principles of the present invention, the mineral matter is essentially free of fines as they are agglomerated with the larger particles of mineral matter through the transfer of surface water from the coal to the mineral matter. These relatively massive agglomerates fall in an essentially vertical line from the feedstock inlet to the bottom of the heavy halogenated hydrocarbon bath used in our process to recover the product coal by density differential separation. The coal particles meanwhile disperse in, and migrate to, the upper reaches of the bath. Consequently, except in the vicinity of the feedstock inlet, the bath is essentially free of mineral matter. This novel elimination of dispersed mineral matter from the bath is highly significant because it facilitates the migration of the product coal particles (especially the fines) toward the top of the bath by eliminating the interference to such migration caused by particulate mineral matter in conventional gravity separation processes.

Also, the envelopment of the coal particles with the surface active agent keeps those particles from agglomerating with particles of mineral matter as they do to a significant extent in conventional heavy liquid gravity separation processes. Agglomeration of the just described character is undesirable because it results in coal reporting to the bottom of the heavy liquid bath with the mineral matter and being lost and in unwanted mineral matter reporting to the top of the bath with the product coal.

There is also good evidence that the presence of the surface active agent on the product coal particles reduces the adverse effect of particle concentration on the viscosity of the bath, and that this phenomenon is independent of the mineral matter agglomeration effect discussed above. The just described viscosity reduction effect is particularly important when small particles are involved as the speed with which such particles migrate to the top of the bath is inversely related to the bath viscosity.

To obtain the wanted agglomeration of the particulate mineral matter, the raw coal being conditioned must have a moisture content of at least two percent in available form. Typically, this will be essentially surface moisture although a small part of the inherent moisture of the coal can be relied upon to make up the required minimum; and water can be added, if necessary, for this purpose.

The presence of water in the separation process does not pose the problem that it does in other coal beneficiation processes because, as discussed above, the water reports to the bottom of the density differential separation bath with the mineral matter in the step in which the product coal is collected. This remains true even though the moisture content of the coal being cleaned may range as high as 10 to 20 percent.

The maximum amount of moisture that can be tolerated without adversely effecting the beneficiation process disclosed herein will vary from application-to-application of our invention but can be readily determined as it is a function of the composite apparent density (CAD) of the mineral matter composites in which the water. If too much water is present, the mineral matter-water composites formed by the transfer of surface moisture may have a CAD which is near, or even lower than, the density of the halogenated hydrocarbon employed in the coal collection step of the process.

In the just related circumstances, two adverse effects may result. The migration of the composites to the bottom of the halogenated hydrocarbon bath may be slowed to the point that the beneficiation process becomes impractical, and significant amounts of the composites may migrate toward the top of the bath with the coal particles leaving the ash content of the product coal at an impractically high level. Those heavy halogenated hydrocarbons useful in conditioning coal in accord with the principles of the present invention and in the subsequent separation of product coal from the mineral matter associated therewith are those which are immiscible with water and which have one or two carbon atoms ($C_1$ and $C_2$ hydrocarbons), two to six halogens atoms, and a specific gravity in the range of 1.2 to 2.2. Halogenated hydrocarbons with specific gravities above 2.2 are of no value for our purpose because so much mineral matter will report to the top of the separation liquid bath with the coal that the resulting product will have no commercial value. In fact, for this same reason, halogenated hydrocarbons having a specific gravity above 1.7 are, generally speaking, of little commercial value for our purposes.

Representative of those compounds we can employ are:

Ethylene Dibromide
Bromotrichloromethane
Bromochloromethane
Pentachloroethane
Tetrachloroethylene
Trichloroethylene
1,1,1-Trichloroethane
Ethylene Dichloride
Perchloroethylene
Carbon Tetrachloride
Methyl Chloroform
Trichlorobromomethane
1,2-Dibromoethane
Fluorobromomethane
1-Chloro-2-bromoethane
1-Chloro-1-bromoethane
Methylene Bromide
Dibromochloromethane
Tribromofluoromethane
Bromodichloromethane
1,2-Dibromo-1,1,2-trichloroethane
1,2-Dibromotetrafluoroethane
1,1,1-Chlorodibromoethane
1,1-Dibromoethane
Chlorodibromomethane
1,1-Chloroiodoethane
1-Chloro-2-iodoethane
1-Fluoro-1,1-dichloro-1,2-dibromoethane
Fluorochlorobromomethane
1,1,1-Trichloro-2,2-dichlorofluoroethane
1,1,1-Trichloro-2-chloro-2-fluoroethane
1-Chloro-2,2,2-trifluoroethane
1,1-Dichloro-2,2,2-trifluoroethane
Dichlorofluoromethane
1-Chloro-2-fluoroethane
1,1,2-Trichloro-1,2,2-trifluoroethane
1,1-Dichloro-1,2,2,2-tetrafluoroethane
Trichlorofluoromethane Tveter and Alexander U.S. Pat. No. 2,151,578 disclose a number of additional halogenated hydrocarbons which are purportedly useful in beneficiating coal. Those of the disclosed compounds which meet the criteria discussed above are among the many other halogenated hydrocarbons that can be used for our purposes.

Mixtures of two or more of the foregoing and other halogenated hydrocarbons can also be employed as long as the halogenated hydrocarbons are miscible and the mixture meets the criteria specified above.

Also, diluents can be added to the halogenated hydrocarbon or mixture thereof to adjust the specific gravity of the process liquid in applications of our invention where this can be done to advantage.

Lower specific gravities can, for example, be obtained by mixing a diluent such as a light petroleum fraction with the halogenated hydrocarbon(s) because of the inertness which such compositions display toward the organic materials in coal and toward such process liquids and because the process liquids are miscible in the light petroleum fraction. The technique can be employed to maintain the specific gravity of the process liquid constant or to vary it in a controlled manner under changing ambient conditions.

Petroleum ether (a mixture of pentane and hexane) can also be employed as a diluent because the amounts involved are sufficiently small that the vapors from the separator are nonexplosive and non-flammable. Other liquids can be employed instead of petroleum fractions. Pentane, for example, has the properties which makes it useful for this purpose.

The concentration of the surface active agent is also important in the practice of our invention. From 0.01 to two pounds per ton of raw coal can be employed.

In any event sufficient surface active agent must be employed to establish a monolayer film on all of the coal particles present in the conditioner, and a smaller overage is preferably provided. This excess accommodates losses attributable to water-halogenated hydrocarbon distribution functions and to cation-induced precipitation of the surface active agent in the aqeuous phase of the raw coal slurry in the conditioner.

Excessive amounts of surface active agent can result in the water present in the conditioner being dispersed as a micellular phase composed of water-ash envelopes less than 1 $\mu$m in diameter in the bath of coal collecting halogenated hydrocarbon liquid. This leads through a build-up of middlings to an increase in the viscosity of the bath and the appurtenant problems discussed above. Also, the reduction of viscosity can lead to further middling build-up with the cycle continuing to the point where the loss in efficiency can make the beneficiation process impractical.

Lower concentrations of surface active agent do not furnish enough of that constituent to insure that all of the coal particles will be enveloped or covered with a film of the surface active agent. To the extent that this does not occur, gravity separation will not proceed in the intended manner; and the advantages of the present invention will not be obtained.

Furthermore, the use of excessive surface active agent is economically disadvantageous, a factor of substantial importance because of the relatively high cost of appropriate compositions.

Among the surface active agents we have successfully employed are the following:

| Surface Active Agent | Type | Composition | Manufacturer |
|---|---|---|---|
| Aerosol OT-100 | Anionic | Dioctyl ester of sulfosuccinic acid | American Cyanamid |
| Aerosol OT-75 | Anionic | Dioctyl ester of sulfosuccinic acid | American Cyanamid |
| Cal Supreme | Cationic | Dioctyl ester of sulfosuccinic acid | Penwalt-Caled Company |
| Perk-Sheen | | | Adco, Inc. |
| Super-Cal | Anionic | Dodecyl benzene sulfonic acid salt | Penwalt-Caled Company |
| Pace-Perk | Anionic | Dodecyl benzene sulfonic acid salt | Penwalt-Caled Company |
| Strodex Super V-8 | Anionic | Complex organic phosphate esters | Dexter Corporation |
| Strodex P-100 | Anionic | Complex polyphosphate ester acid anhydride | Dexter Corporation |
| Witconate P10-59 | Anionic | Amine salt of dodecylbenzene sulfonic acid | Witco Chemical Corporation |
| Witcomine | Cationic | 1-Polyaminoethyl-2n-alkyl-2- imidazoline | Witco Chemical Corporation |
| Triton Gr-7M | Anionic | Dioctyl sodium sulfonate plus solvent | Rohm and Haas |
| OTS | Anionic | Seventy percent solution of dioctyl sulfo sodium succinate in mineral spirits | American Cyanamid |

Typically, the surface active agents we employ are solids at room temperature. However, suitable surface active agents are soluble in water and/or the heavy halogenated hydrocarbons we employ; and they can be employed by dissolving them in a solvent of the foregoing character.

Typically, the organic type solvent will be employed. Agitation of the raw coal with the halogenated hydrocarbon appears to be essential to cause moisture to transfer to the particles of mineral matter and effect the wanted agglomeration of those particles. As a halogenated hydrocarbon will consequently be supplied to the conditioner in any event, use of that constituent makes it unnecessary to use yet another substance as the surface active agent solvent.

Other parameters of signal importance in the practice of our invention are the weight percent of raw coal in the conditioner slurry and the residence time of the raw coal in the conditioner (i.e., the period for which the coal is agitated in the presence of the surface active agent and the halogenated hydrocarbon).

Slurries containing 50 to 80 percent by weight of solids are suitable.

Higher solids concentrations may result in incomplete conditioning and, more particularly, in a failure to completely wet all of the coal particles with the solution of the surface active agent. Solids concentrations below the specified minimum can result in a long range diffusion of the molecules of surface active agent which has the same adverse result.

In general, solids concentrations should be related to the size distribution of the raw coal particles. For example, as the top size of the raw coal increases, the time required for conditioning the coal in a dilute slurry decreases. The requisite residence time for complete conditioning may not be available in such cases as a practical matter; and the concentration of raw coal in the slurry should accordingly be increased to insure that complete conditioning and the maximum removal of mineral matter that results are obtained.

In typical applications of our invention, the problems discussed above can be avoided by employing a solids concentration on the order of 60 weight percent.

We employ residence times in the range of 0.2 to five minutes. Shorter times are not sufficient to complete the wanted agglomeration of the particulate mineral matter, and longer residence times are economically impractical. Typically, a residence time on the order of 30 to 60 seconds will be employed as the wanted conditioning will have been completed by then to an extent which makes further residence time impractical from the economic viewpoint. The particular time employed will depend primarily on the surface active agent used; and the residence time for a particular composition can be readily optimized by actual test, if necessary.

The type or pattern of agitation employed in the conditioner can be varied as desired. High speed, egg beater, propeller, spoon type, screw, and wrist action agitations have all been employed with no significant variation in results as measured in terms of yield and ash content of the product coal.

The use of surface active agents in gravity separation processes using halogenated hydrocarbon heavy liquids has heretofore been discussed in Tveter, Aplan, and Foulke et al U.S. Pat. Nos. 2,208,758, and in 2,165,607 issued July 11, 1939, to Blow.

Blow, however, is not concerned with the cleaning of coal; and there is nothing in his patent which would leave one to believe that surface active agents could be used to advantage to coal beneficiation processes. Furthermore, Blow does not use surface active agents in a manner which—as is an important feature of our invention—effects an agglomeration of unwanted mineral matter or gangue. In his process such agents are used only to displace the process liquid from the particles of wanted and unwanted materials after they have been separated.

Foulke et al chose surface active agents which would fix a water film on the product coal being recovered rather than freeing it from that material for removal to the sinks and the formation of agglomerates. This is completely different from the use we make of surface active agents in the process described herein.

The process liquids which Aplan uses in the beneficiation of coal are aqueous suspensions of solid particles. The patent teaches nothing concerning the use of surface active agents in conjunction with halogenated hydrocarbon heavy liquid type media except for implying that this can be done.

Our use of surface active agents in coal beneficiation is also readily distinguishable from Tveter's. Tveter ties the amount of surface active agent he employs to the amount of process liquid being employed, not to the amount of coal being conditioned as is necessary in our process.

Also, the Tveter process requires that the coal being treated have (or be dried to) a maximum moisture content of two weight percent. Our process, in contrast, requires that this much moisture be present as a minimum; and it is equally useful in beneficiating coals having much higher moisture contents.

Another feature which radically distinguishes our process from those just discussed prior art coal beneficiation processes employing surface active agents is that the coal being beneficiated is conditioned with a halogenated hydrocarbon as well as the surface active agent. This leads to the much different results discussed above.

Also, in those processes disclosed in the foregoing patents, the surface active agent is not employed in a conditioning step as it is in our process. It is instead added to the parting liquid in a gravity separator. Our technique has the advantage that amount, exposure, and time factors can be optimized independent of the separation stage in addition to keeping the mineral matter from dispersing in the coal collection bath and inhibiting the migration of particles through that bath.

From the foregoing it will be apparent to the reader that one important and primary object of our invention resides in the provision of novel improved methods for beneficiating raw coal to separate product coal from refuse associated therewith.

Another important and primary object of our invention is the provision of novel improved methods for conditioning raw coal which facilitate the subsequent recovery of the product coal from refuse associated therewith in the raw coal.

Still other important but more specific objects of our invention include the provision of methods as aforesaid:

which are efficient and economical;

which can be carried out at ambient pressure and temperature or under conditions which vary only modestly from ambient;

which are efficient even when the moisture content of the coal to be processed is higher than is acceptable in comparable prior art processes;

in which the separation of the coal from the associated gangue proceeds rapidly;

which do not have the slime and flocculation problems common to many gravity separation processes;

in which the raw coal is so conditioned as to effect an agglomeration of the mineral matter associated therewith while inhibiting the agglomeration of the coal particles with the mineral matter;

in which, in conjunction with the preceding object, the conditioned coal is introduced into a body of liquid having an intermediate specific gravity to effect a recovery of the coal by density differential separation;

which, in conjunction with the preceding object, minimize the presence of middlings in the product coal collecting bath and the appurtenant increase in the viscosity of the bath attributable to middlings.

Other important objects and features and additional advantages of our invention will be apparent to those knowledgeable in the relevant arts from the foregoing and from the appended claims and examples and from the detailed description and discussion which follows taken in conjunction with the accompanying drawing.

Briefly described, the single FIGURE of the drawing is a schematic illustration of a plant for beneficiating coal in accord with the principles of the present invention to recover product coal from mineral matter associated therewith.

Referring now to the drawing, the single FIGURE schematically depicts a plant or system 20 for cleaning coal which is constructed in accord with the principles of the present invention. The major components of system 20 include a conditioning tank or conditioner 22. The raw coal to be cleaned is transferred from a storage facility to the conditioning tank as by screw conveyor 24.

The plant also includes: a separator 26 in which conditioned coal is recovered from mineral matter associated therewith; evaporators 28 and 30 for recovering a halogenated hydrocarbon used as discussed above from the product coal (or floats) and the refuse (or sinks); and a system identified generally by reference character 32 for recovering the process liquid in vapor form from conditioning tank 22, separator 26, and evaporators 28 and 30; condensing the vapor to liquid; and returning the liquid to storage tank 34. Also incorporated in the system are a storage facility 36 from which a surface active agent can be introduced into tank 22 by pump 38 and a heating system 40 for adjusting the effective temperature of the coal in the conditioning tank before it is transferred to separator 26.

The conveyor 24 for feeding the raw coal into the conditioning unit can be of the screw or auger type. As shown in the drawing, it will typically be positioned with a gap between its discharge end and the surface of the liquid in the conditioner. This keeps vaporized liquid in the conditioner, necessarily under some pressure, from blowing out through the conveyor when raw coal is introduced into the conditioner.

The halogenated hydrocarbon conditioning liquid is pumped at a controlled rate by pump 41 to the discharge side of pump 38 where it is premixed with the surface active agent to insure subsequent homogeneous distribution of the latter and the complete wetting of the product coal particles.

The mixture of halogenated hydrocarbon and surface active agent then flows to conditioning tank 22 where the liquid phase and raw coal introduced by conveyor 24 are formed into a slurry and agitated by agitator 42. This results in a transfer of water from the product coal to the mineral matter associated therewith, a coalescence of the mineral matter particles into relatively massive agglomerates, and the surrounding of the product coal particles with films of surface active agent.

As discussed above, we consider it necessary to have at least two weight percent of water based on the weight of the raw coal present in the conditioner. Water necessary to meet this requirement is introduced into the conditioner through line 43.

The heating system 40 alluded to above may be utilized to add to the slurry in conditioner 22 such heat as may be necessary to subsequently control the temperature, and therefore the specific gravity, of the process liquid in separator 26. Heating system 40 includes a tube type or other circulating liquid heat exchanger 44 in the bottom of conditioning tank 22 and a pump 46 for circulating steam or hot water from a boiler 48 to and through heat exchanger 44 and back to the boiler.

The mixture formed in conditioning tank 22 is transferred to separator 26 as by a screw type conveyor 50.

Recovery of the product coal from the mineral matter associated therewith is effected by density differential separation in our process; and the separation step can, in general, be carried out in any of the various types of separators operating on this principle. The separator may in this respect be either of the stationary media (static) type shown in the drawing or of the flowing media (dynamic) type. An example of the latter is the centrifugal separator disclosed in U.S. Pat. No. 2,109,234 issued Feb. 23, 1938, to Keenan. Other suitable density differential separators, including several of the flowing media type, are described in Taggart, HANDBOOK OF MINERAL DRESSING, John Wiley & Sons, Inc., New York, N.Y., 1927, Chapter 11, pp. 1–140.

In the illustrated static media separator, the mineral matter agglomerates sink in a generally vertical path from the discharge end of conveyor 50 to the bottom of separator 26. The coal particles disperse in the bath of liquid 52 in the separator because of their envelopes of surface active agent and then migrate to the top of the bath.

The product coal is skimmed from the surface of bath 52 as by an auger conveyor 54, preferably equipped with folding flights. This skimmer discharges the product coal into the lower, feed end of an upwardly inclined conveyor 55. The conveyor transfers the coal to floats evaporator 28. As the coal moves upwardly through transfer conveyor 55, the bulk of the process liquid drains from it and flows by gravity back into separator 26.

Refuse is removed from the bottom of separator 26 as by a folding flight, auger conveyor 56 and discharged into the lower, feed end of a second, upwardly inclined, transfer conveyor 58 in which the process liquid drains from the refuse into separator 26. From conveyor 58, the refuse is discharged into sinks evaporator 30.

Evaporators 28 and 30 will typically be of the indirect, conductive type. Examples of such evaporators which are suitable are the rotary, steam tube, and Holo-Flite types. Steam or hot water is supplied to the evaporators to vaporize the process liquid associated with the floats and sinks from boiler 48 by pump 46 through supply conduit system 59. After circulating through the evaporators, the heat exchange medium returns to the boiler through fluid conduit system 60.

For the sake of clarity, sinks evaporator 30 is shown at a lower elevation than floats evaporator 28 in the drawing. In actual practice it is located at approximately the same level as evaporator 28 so liquid can drain back into separator 26 which it could not do if the evaporator were located at the illustrated level.

The process liquid free product coal and rejects are discharged from evaporators 28 and 30 to material handling systems indicated generally by arrows 61 and 62 in the drawing. The refuse is transferred to a gob pile and the product coal to the point-of-use or to a coking or other coal treating operation.

Vaporized process liquid generated in evaporators 28 and 30 is combined with that from conditioning tank 22 and separator 26 in a line 63 leading to the inlet side of a compressor 64. As the vapor conditioning tank 22 may carry a significant amount of entrained fines, this vapor is first preferably scrubbed with process liquid in a conventional scrubber 66.

After flowing from the compressor through a valve 67 employed to maintain pressure in the system, the vaporized process liquid is circulated through a condenser 67 which may be of the conventional shell and tube type. Cooling liquid (typically water) at a temperature on the order of 85° F. is circulated from the lower end of a conventional cooling tower 72 through the condenser by pump 74 to condense the process liquid.

After exiting from the condenser, the water, now at a temperature on the order of 95° F., returns to and is sprayed into the upper end of the cooling tower through nozzles 76. As the water flows down through the cooling tower, it is contacted by an upwardly moving stream of air generated by cooling tower fan 78. This reduces its temperature to the level at which it is circulated to condenser 68.

Condensed process liquid flows through an expansion valve or orifice 80 to reduce its pressure to atmospheric and then to the process liquid storage facility or tank 34.

Noncondensible gases and any process liquid which may not have condensed proceed from condenser 68 to a purge unit 82. This may be a scrubber or other absorption type device or a mechanically refrigerated unit, for example. The remaining process liquid is condensed in this unit and returned to storage tank 34.

Noncondensible gases flow through a conduit system identified generally by reference character 84 to the floats and sinks evaporators 28 and 30. The gases are circulated through these evaporators in countercurrent relationship to the solid material to strip process liquid vapors from the solid material.

In cleaning some coals, middlings may be generated despite the conditioning of the raw coal in the manner described above. Pump 86 can be employed to remove middlings from separator 26. This pump circulates the middlings and process liquid in which they are entrained from a zone in bath 52 intermediate those to which the floats and sinks report to a cyclone, centrifuge, or other polishing device 88. Here, the solids are separated from the process liquid and discharged from the separator as indicated by arrow 90. Depending upon the proximate analysis of these solids, they are conveyed to either the floats evaporator 28 for clean coal or the sinks evaporator 30 for refuse. The process liquid is pumped to either conditioning tank 22 as shown by solid line 92 or to gravity separation tank 26 as shown by dotted arrow 94.

As will be apparent to the reader, variations can be made in the illustrated equipment. Other types of conveyors may be used. The conditioner tank and agitator may be replaced with a pug mill, jacketed screw conveyor, or other blender, etc. Centrifuges can be employed instead of or in addition to drip drying as in conveyors 55 and 58 to remove process liquid (ca. 97 percent) from the solids as can static and vibrating screens, etc. And shelf-type and other kinds of evaporators can be used instead of those discussed above. Still other alternatives will readily suggest themselves to those skilled in the relevant arts.

Also, other techniques can be employed to disperse the surface active agent on the particles of coal. For example, the surface active agent can be dispersed in an appropriate liquid carrier and sprayed directly on the raw coal; and steam can also be used as the vehicle for the transport of the surface active agent.

The efficacy of our novel process was demonstrated by tests in which samples of Ohio No. 9 (Muskingum) and Upper Freeport coals were divided into lots as prescribed by ASTM Standard No. D2013-72. One lot was employed to characterize the raw coal as follows as to size consist and bulk water content.

| Coal | Size Consist | Moisture Content |
|---|---|---|
| Muskingum | 30 mesh × 0 | 4.51 wt % |
| Upper Freeport | 30 mesh × 0 | 7 wt % |

Other samples of the foregoing coals were added to a subsequently stoppered flask with the additional ingredients and in the proportions tabulated below:

1 lb/ton OTS surface active agent
40 wt % halogenated hydrocarbon
60 wt % coal

The stoppered flasks were agitated for five minutes in a wrist action shaker. At the completion of each such operation, the contents of the flask were immediately transferred to a one gallon glass cylinder containing the same halogenated hydrocarbon employed in conditioning the coal. After briefly stirring the contents of the cylinder, the product coal was allowed to separate; and it and the mineral matter (refuse) were separately recovered from the cylinder and analyzed for moisture content. The results are tabulated below:

Muskingum Coal

Conditioning and separating liquid—trichlorofluoromethane

| | | |
|---|---|---|
| Product Coal (Floats) | 1.82 | Water, % Wt |
| Refuse (Sinks) | 7.65 | |

Conditioning and separating liquid—trichloroethylene

| | | |
|---|---|---|
| Product Coal (Floats) | 1.80 | Water, % Wt |
| Refuse (Sinks) | 6.83 | |

Conditioning and separating liquid—carbon tetrachloride

| | | |
|---|---|---|
| Product Coal (Floats) | 2.44 | Water, % Wt |
| Refuse (Sinks) | 9.39 | |

Upper Freeport Coal

Conditioning and separating liquid—trichlorofluoromethane

| | | |
|---|---|---|
| Product Coal (Floats) | 1.9 | Water, % Wt |
| Refuse (Sinks) | 9.3 | |

-continued

Conditioning and separating liquid—trichloroethylene

| | | |
|---|---|---|
| Product Coal (Floats) | 2.91 | Water, % Wt |
| Refuse (Sinks) | 9.49 | |

Conditioning and separating liquid—carbon tetrachloride

| | | |
|---|---|---|
| Product Coal (Floats) | 2.48 | Water, % Wt |
| Refuse (Sinks) | 6.66 | |

Conditioning and separating liquid—1,1,2-trichloro-1,2,2-trifluoroethane

| | | |
|---|---|---|
| Product Coal (Floats) | 1.54 | Water, % Wt |
| Refuse (Sinks) | 6.15 | |

That the bulk of the moisture was in each case found to constitute part of the refuse demonstrates the efficacy of our process. Associated with product coal, water is an unwanted impurity as indicated above. Also, that there was a significant transfer of water to the refuse means that agglomeration of the mineral matter particles could take place; and this, too, results in a reduction of unwanted impurities.

Furthermore, that substantial amounts of water transferred to the refuse indicates that the concentration of water solids composites in the bath of separating liquid was at least significantly lower than would have been the case without conditioning. This is important because, as discussed above, such composites tend toward an intermediate specific gravity, adversely affecting the efficiency of the separation step and the reduction in mineral matter content which that step is capable of producing.

The data also demonstrates that the efficacy of our process is not tied to the use of a particular halogenated $C_1$ or $C_2$ hydrocarbon but that compounds in that class can in general be used for our purposes if they meet the other criteria specified above.

The efficacy of the conditioning step employed in our process has also been verified by analyzing the ash content of solids collected at different levels and locations in the density differential separation bath and comparing the results with the ash content of the product coal. No significant difference in ash content has been found which is a clear indication that the conditioning step has effected a sharp separation of the product coal from the associated mineral matter.

Numerous preferred embodiments of our invention have been described above in varying degrees of detail. However, the invention may be embodied in still other specific forms without departing from the spirit or essential characteristics thereof. The disclosed embodiments are therefore to be considered in all respects as illustrative and not restrictive, the scope of the invention being indicated by the appended claims rather than by the foregoing description; and all changes which come within the meaning and the range of equivalency of the claims are therefore intended to be embraced therein.

What is claimed and desired to be secured by Letters Patent of the United States is:

1. A method of beneficiating raw coal to separate particles of product coal from particles of mineral matter associated therewith, said process comprising the steps of: conditioning said raw coal by agitating it in slurry with a surface active agent and with a halogenated $C_1$ or $C_2$ hydrocarbon in amounts and for a time sufficient to effect a transfer of moisture to the mineral matter, an agglomeration of the mineral matter particles, and the envelopment of the product coal particles with the surface active agent; transferring the conditioned coal to a separator containing a bath comprising a halogenated $C_1$ or $C_2$ hydrocarbon having a specific gravity intermediate those of the product coal and the mineral matter; maintaining the conditioned coal in said bath for a period of sufficient duration to effect the movement of the agglomerated mineral matter to the bottom of said bath and to effect the dispersion of the product coal particles in the bath and the migration of said particles to the top of the bath; and removing from said bath the product coal thus recovered from the mineral matter associated therewith.

2. A method as defined in claim 1 in which said halogenated hydrocarbon is immiscible with water and has a specific gravity in the range of 1.2 to 2.2 and from two to six halogen atoms.

3. A method as defined in claim 2 in which the surface active agent is employed in said conditioning step in an amount ranging from 0.1 to 2 pounds per ton of raw coal and in an amount sufficiently large to form at least a monolayer on the particles of product coal but sufficiently small to avoid precipitation of said surface active agent in the aqueous phase in the slurry in which the conditioning takes place and the formation of a micellular aqueous phase therein.

4. A method as defined in claim 1 in which said product coal is recovered by dynamic density differential separation.

5. A method as defined in claim 1 in which said product coal is recovered by a static density differential separation.

6. A method as defined in claim 1 in which the moisture content of the raw coal is adjusted, if necessary, to a minimum of two percent based on the weight of said coal before the coal is conditioned.

7. A process as defined in claim 1 in which the raw coal constitutes from 50 to 80 weight percent of the constituents combined in the conditioning step and in which the concentration of surface active agent is sufficiently low to insure that the product coal particles are completely wet with a liquid surface active agent solution but sufficiently high to avoid long range diffusion of the surface active agent into the liquid phase generated in the conditioning step.

8. A process as defined in claim 1 in which said agitation is continued for a period of 0.2 to 5 minutes.

9. A method of conditioning raw coal to facilitate the recovery of product coal particles from particles of mineral matter associated therewith, said method comprising the step of: agitating the raw coal with a surface active agent and a halogenated $C_1$ or $C_2$ hydrocarbon in amounts and for a time sufficient to effect a transfer of moisture to the mineral matter, an agglomeration of the mineral matter particles, and the envelopment of the product coal particles with surface active agent.

10. A method as defined in claim 9 in which said halogenated hydrocarbon is immiscible with water and has a specific gravity in the range of 1.2 to 2.2 and from two to six halogen atoms.

11. A method as defined in claim 9 in which the moisture content of the raw coal is adjusted, if necessary, to a minimum of two percent based on the weight of said coal before the coal is conditioned.

12. A method as defined in claim 9 in which the surface active agent is employed in said conditioning step in an amount ranging from 0.1 to 2 pounds per ton of raw coal and in an amount sufficiently large to form at least a monolayer on the particles of product but sufficiently small to avoid precipitation of said surface active agent in the aqueous phase of the slurry in which the conditioning takes place and the formation of a micellular aqueous phase therein.

13. A process as defined in claim 9 in which the raw coal constitutes from 50 to 80 weight percent of the constituents combined in the conditioning step and in which the concentration is sufficiently low to insure that the product coal particles are completely wet with the liquid in which the surface active agent is dissolved but sufficiently high to avoid long range diffusion of the surface active agent into the liquid phase generated in the conditioning step.

14. A process as defined in claim 9 in which said agitation is continued for a period of 0.2 to 5 minutes.

* * * * *